US007270242B2

(12) United States Patent
Liu

(10) Patent No.: US 7,270,242 B2
(45) Date of Patent: Sep. 18, 2007

(54) MODULAR RACK FOR DISPLAYING TOOLS AND MERCHANDISE

(76) Inventor: Hsing-Hui Liu, No. 11, Lane 361, Fengzhou Rd., Shengang Hsiang, Taichung Hsien (TW)

( * ) Notice: Subject to any disclaimer, the term of this patent is extended or adjusted under 35 U.S.C. 154(b) by 59 days.

(21) Appl. No.: 10/984,086

(22) Filed: Nov. 9, 2004

(65) Prior Publication Data

US 2006/0096939 A1 May 11, 2006

(51) Int. Cl.
*A47B 57/00* (2006.01)

(52) U.S. Cl. ..... 211/189; 211/207; 248/188.8

(58) Field of Classification Search ..... 211/175, 211/189, 207; 248/188.8, 149, 159, 424, 248/172

See application file for complete search history.

(56) References Cited

U.S. PATENT DOCUMENTS 3,602,159 A * 8/1971 Marschak ..... 108/187
4,193,233 A * 3/1980 VandenHoek et al. ..... 52/126.4
5,295,596 A * 3/1994 Squitieri ..... 211/175
5,433,327 A * 7/1995 Benvenuti et al. ..... 211/193
5,660,637 A * 8/1997 Dodge ..... 118/500
5,918,750 A * 7/1999 Jackson ..... 211/189
5,944,203 A * 8/1999 Vlah et al. ..... 211/189
6,062,399 A * 5/2000 Henry et al. ..... 211/103
6,089,387 A * 7/2000 Varfolomeeva ..... 211/181.1
6,164,467 A * 12/2000 DePottey et al. ..... 211/189

* cited by examiner

*Primary Examiner*—Richard E. Chilcot, Jr.
*Assistant Examiner*—Jared W. Newon
(74) *Attorney, Agent, or Firm*—Jackson Walker, LLP

(57) ABSTRACT

A modular rack for displaying tools and merchandise has a base, two rod assemblies and multiple display panels. The base has two adjustable foot frames. The rod assemblies are attached to the adjustable foot frames and individually comprise at least two exterior rods and at least one interior connector. Each exterior rod has multiple mounting slots. The display panels attach to the exterior rods of the two rod assemblies and individually have multiple hooks corresponding to and engaging the multiple mounting slots in the rod assemblies. Adding exterior rods and corresponding connectors extends the modular rack in height. Connecting other display panels on an adjacent modular rack to the mounting slots in a common rod assembly extend the modular rack in width. Assembly of most elements in the modular rack is accomplished by inserting the hooks in the mounting slots. Therefore, assembly and disassembly of the modular rack are convenient.

5 Claims, 9 Drawing Sheets

MODULAR RACK FOR DISPLAYING TOOLS AND MERCHANDISE

BACKGROUND OF THE INVENTION

1. Field of the Invention

The invention relates to a rack, and more particularly to a modular rack that can be assembled conveniently in various configurations.

2. Description of Related Art

With reference to FIG. 9, a conventional modular rack essentially comprises a base (50), two side rods (60) and multiple display panels (70).

The base (50) is a parallelepiped box having a front, a rear, a top, a bottom and two sides. The base (50) has a door (52) mounted on the front of the base (50).

The two side rods (60) are firmly attached to the rear at the two sides of the base (50) and are parallel to each other. The side rods (60) are attached to the base (50) with screws (not numbered).

The multiple display panels (70) are detachably secured between the two side rods (60) over the base (50). Each display panel (70) has a front panel and multiple side sheets (74). Each front panel has multiple hanging holes (72), and the side sheets (74) are vertically formed respectively at opposite ends of the front panel to attach respectively to the side rods (60). The display panels (70) are attached to the side rods (60) with screws.

The conventional modular rack has the following drawbacks:

1. Because the elements are connected with screws, assembling or disassembling the conventional modular rack is troublesome and time-consuming especially when the screws must be removed from the side rods one by one.

2. The conventional modular rack has a single size and cannot be extended in either width or in height to display more merchandise. Variations of the conventional rack module are rare.

The present invention has arisen to provide a modular rack for displaying tools and merchandise to obviate the drawbacks of the conventional rack module.

SUMMARY OF THE INVENTION

The main objective of the present invention is to provide a modular rack for displaying tools and merchandise, which can be assembled conveniently.

Another objective of the present invention is to provide a modular rack for displaying tools and merchandise, which can be assembled in various configurations to satisfy various users' requirements.

To achieve the above objectives, the modular rack in the present invention comprises a base, two rod assemblies and multiple display panels.

The base has two adjustable foot frames that can be adjusted in width.

The rod assemblies are attached detachably and respectively to the adjustable foot frames and individually comprise at least two exteriors rods and at least one interior connector. Adjacent exterior rods connect to an interior connector. Each exterior rod has a front face, a rear face and multiple mounting slots defined in the front face and the rear face.

The display panels detachably and selectively attach to the front faces and the rear faces of the rod assemblies and individually have multiple hooks corresponding to and engaging the multiple mounting slots in the rod assemblies.

By adding exterior rods and the corresponding connectors, the modular rack can be extended in height. The mounting slots in the rod assemblies allow the display panels on an adjacent modular rack to connect to a common rod assembly so the modular rack can be extended in width. Moreover, most assembly of elements in the modular rack is accomplished by simply inserting hooks into the corresponding mounting slots. Therefore, assembly and disassembly of the modular rack are easy and convenient.

Further benefits and advantages of the present invention will become apparent after a careful reading of the detailed description in accordance with the drawings.

DETAILED DESCRIPTION OF THE PREFERRED EMBODIMENT

A modular rack for displaying tools and merchandise in accordance with the present invention comprises a base, two rod assemblies and multiple display panels.

The base has two adjustable foot frames with an adjustable width.

The rod assemblies are attached detachably and respectively to the adjustable foot frames and individually comprise at least two exterior rods and at least one interior connector. Adjacent exterior rods connect to an interior connector. Each exterior rod has a front face, a rear face and multiple mounting slots defined in the front face and the rear face.

The display panels detachably and selectively attach to the front faces and the rear faces on the exterior rods of the two rod assemblies and individually have multiple hooks corresponding to and engaging the multiple mounting slots in the rod assemblies.

By adding exterior rods and the corresponding interior connectors, the modular rack can be extended in height. The mounting slots in the rod assemblies allow other display panels on an adjacent modular rack to connect to a common rod assembly so the modular rack can be extended in width. Moreover, assembly of most elements in the modular rack is accomplished by simply inserting hooks into the corresponding mounting slots. Therefore, assembly and disassembly of the modular rack are easy and convenient.

Figure 1:
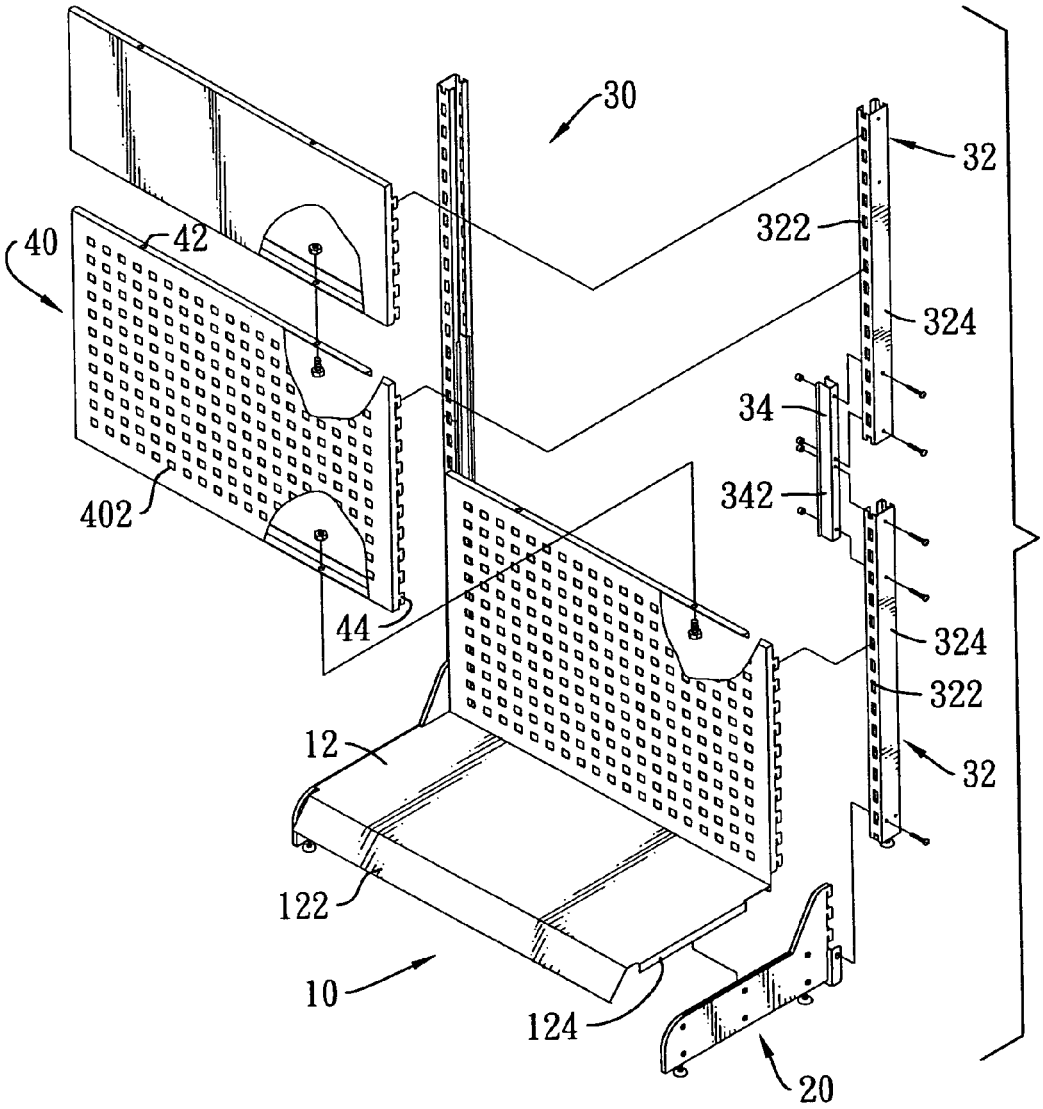
FIG. 1 is an exploded perspective view of a modular rack for displaying tools and merchandise in accordance with the present invention.

With reference to FIG. 1, a preferred embodiment of the modular rack in accordance with the present invention has a base (10), two rod assemblies (30) and multiple display panels (40).

The base (10) has two adjustable foot frames (20) and a footplate (12) secured between the adjustable foot frames (20) adjustable in width. The footplate (12) has a front end, a rear end, two sides, an optional inclined toe guard (122) and two connecting lips (124). The inclined toe guard (122) is formed at the front end. The two connecting lips (124) extend perpendicular down respectively from the two sides of the footplate (12).

Figure 2:
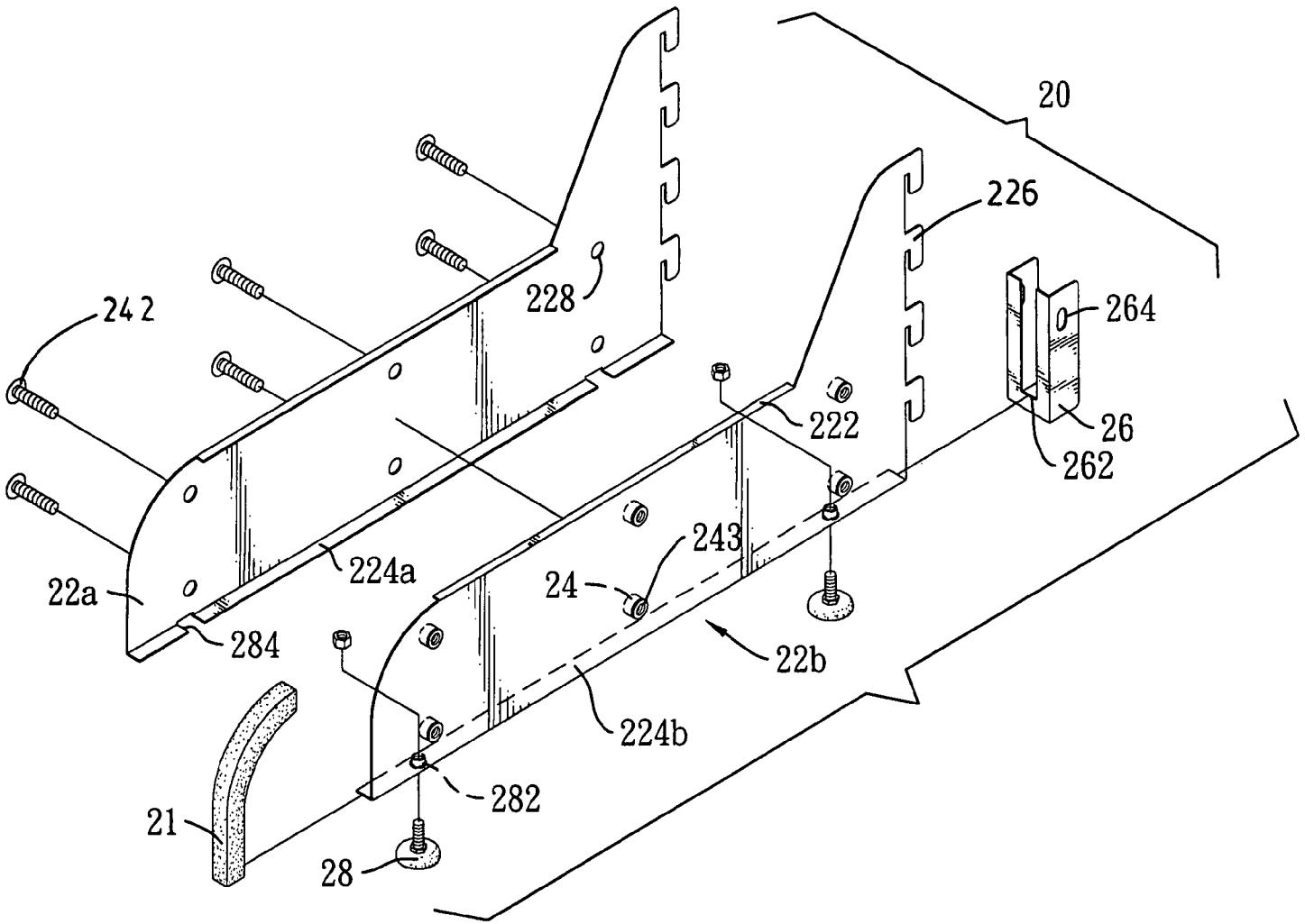
FIG. 2 is a partially exploded perspective view of a foot frame on a base of the modular rack in FIG. 1.

With further reference to FIG. 2, each adjustable foot frame (20) is composed of two symmetrical panels (22*a*, 22*b*) that are particularly defined as a first panel and a second panel, multiple separators (24) having corresponding screws (242), a bracket (26), multiple feet (28) and an optional dressing strip (21).

The symmetrical panels (22*a*, 22*b*) individually have a front end, an enlarged rear end, a top edge, a bottom edge, an inside surface, a rear edge, multiple hooks (226), a clamping flange (222) and an overlapping flange (224). The first panel (22*a*) further has multiple holes (228). The second panel (22*b*) further has multiple separators (24) mounted on the inside surface and corresponding to the holes (228) in the first panel (22*a*). Each separator (24) is cylindrical and has a threaded hole (243) axially formed through the separator (24). The front end of each symmetrical panel (22*a*, 22*b*) is curved at the top edge of the panel (22*a*, 22*b*). The enlarged rear end of each symmetrical panel (22*a*, 22*b*) is diverges from the top edge. Multiple hooks (226) are formed on each enlarged rear edge. The clamping flanges (222) are formed respectively on the top edges of the symmetrical panels (22*a*, 22*b*), and extend toward the opposite symmetrical panel (22*a*, 22*b*). Each clamping flange (222) has a width. The clamping flanges (222) on the foot frames (20) clamp the connecting lips (124) on the footplate (12) and hold the footplate (12) in place. The connecting lips (124) on adjacent footplates (12) may be mounted between the same clamping flanges (222). The overlapping flanges (224*a*, 224*b*) are formed respectively on the bottom edges, extend toward the opposite symmetrical panels (22*a*, 22*b*) and are respectively named as a first overlapping flange (224*a*) and a second overlapping flange (224*b*). Each overlapping flange (224*a*, 224*b*) has a width at least two times larger than the width of the clamping flange (222). The first overlapping flange (224*a*) on the first symmetrical panel (22*a*) has multiple notches (284) and the second overlapping flange (224*b*) has multiple threaded rings (282). Each threaded ring (282) is formed on the top of second overlapping flange (224*b*) and extends through the notch (284) in first other overlapping flange (224*a*) when the overlapping flanges (224*a*, 224*b*) overlap each other.

The screws (242) pass respectively through the holes (228) in the first panel (22*a*) and screw respectively into the separators (24) on the second panel (22*b*) to clamp the separators (24) between the panels (22*a*, 22*b*) and draw the clamping flanges (222) together. The screws (242) may be loosened to allow more space between the clamping flanges (222). Therefore, the foot frame (20) is adjustable in width.

The bracket (26) is firmly attached to the enlarged rear ends near the bottom edges of the symmetrical boards (22) to engage a corresponding rod assembly (30), is U-shaped, is preferably welded to the symmetric panels (22*a*, 22*b*) at the bottom edge near the rear edge and has a front, a top, two wings, a slot (262) and two holes (264). The slot (262) is defined in the front, extends to the top and holds the rear edge near the bottom of the panels (22*a*, 22*b*) and the overlapping flanges (224*a*, 224*b*). The holes (264) are defined respectively in the wings of the bracket (26) near the top.

The feet (28) are detachably attached respectively to the threaded rings (282) on the overlapping flange (224) and individually have a round base and a threaded rod. The threaded rods are formed respectively on and extend up from the round bases and screw respectively into the threaded rings (282).

The dressing strip (21) is made of resilient material such as resilient foam material and is clamped between the two symmetrical panels (22*a*, 22*b*) at the front end to make the foot frame (20) appear neat.

Figure 6:
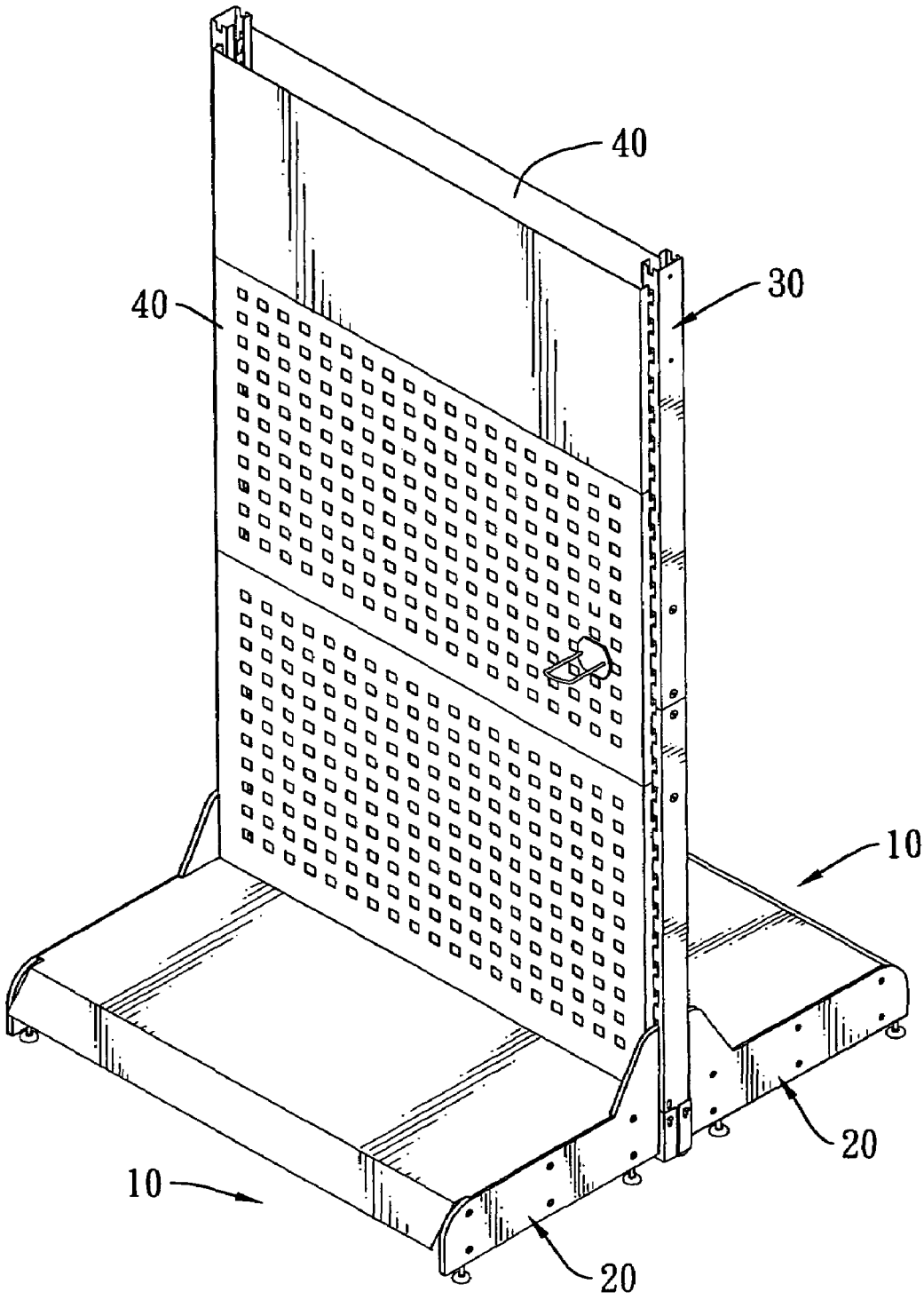
FIG. 6 is a perspective view of the modular rack that has display panels at both the front and the rear of the modular rack.

The rod assemblies (30) are attached respectively to the brackets (26) on the foot frames (20) and individually comprise at least two exterior rods (32) and at least one interior connector (34). The exterior rods (32) are U-shaped and individually have a front face, a rear face, an outer side (324), an open inner side, a longitudinal recess and multiple mounting slots (322). The multiple mounting slots (322) are defined through the front face and the rear face of the exterior rod (32) at equal intervals, communicate with the interior recess and have two internal recesses. Each interior connector (34) is mounted inside the longitudinal recesses of adjacent exterior rods (32) and is attached to the adjacent exterior rods (32) to allow the rod assemblies (30) to be extended in length. The interior connector (34) is also U-shaped and has an inner edge (342) and two sides. When the interior connector (34) connects adjacent exterior rods (32), the inner edge (342) of the interior connector (34) is mounted in the longitudinal recesses of adjacent exterior rods (32) and abuts the outer sides (324) of the adjacent exterior rods (32). The interior connector (34) is held firmly in place by multiple screws penetrating the inner edge (342) of the interior connector (34) and the outer sides (324) of the two adjacent exterior rods (32). With further reference to FIG. 6, the rod assemblies (30) can be extended in height by adding more exterior rods (32) and interior connectors (34) between adjacent exterior rods (32).

Figure 3:
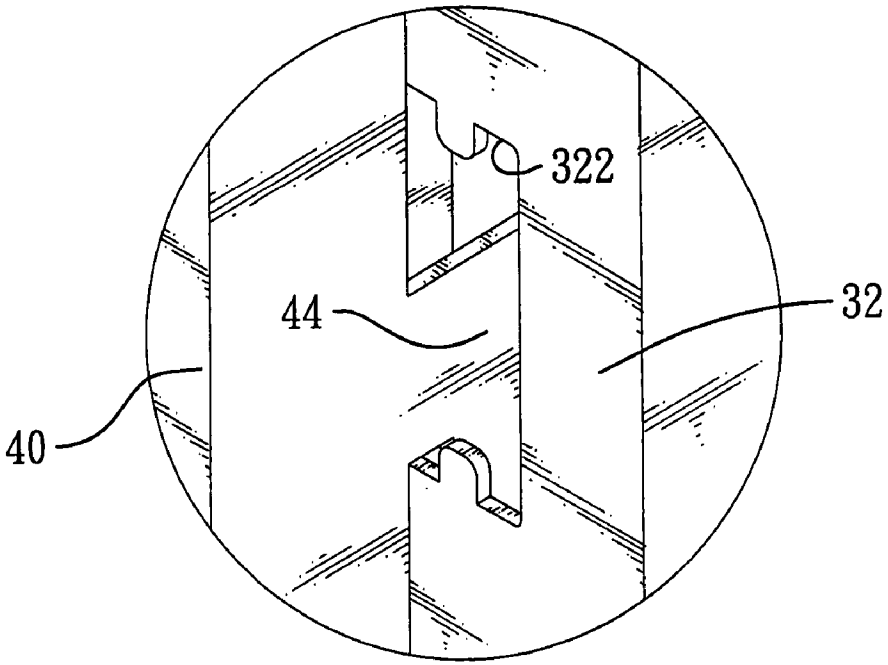
FIG. 3 is an enlarged perspective view a hook on a panel engaging a mounting slot in a rod assembly of the modular rack in FIG. 1.
Figure 7:
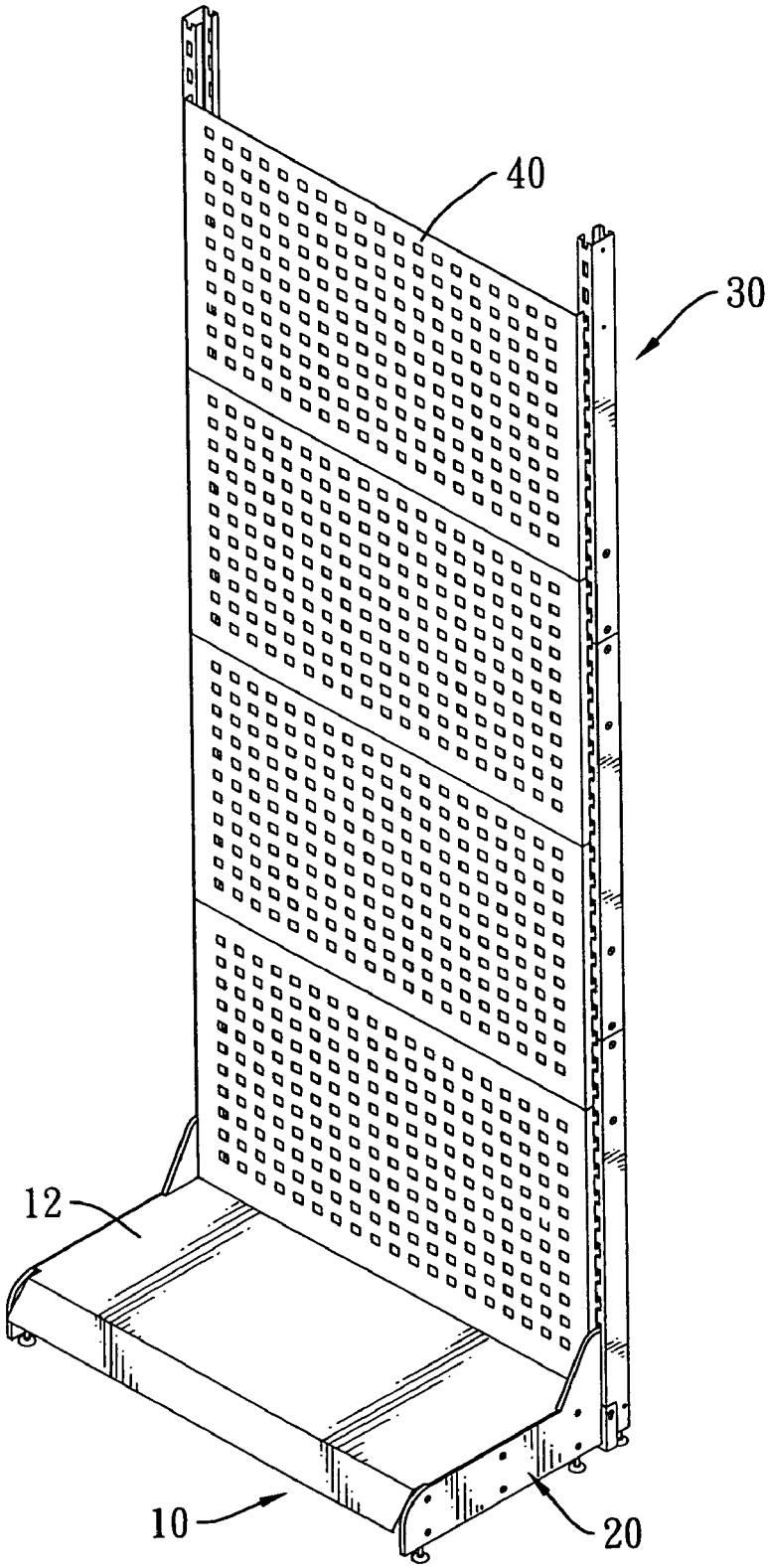
FIG. 7 is a perspective view of an embodiment of the modular rack extended in height in accordance with the present invention.

Each display panel (40) is rectangular, is attached between adjacent rod assemblies (30) and has a top, a bottom, two sides, a front surface, a rear surface, two flanges (42), multiple hooks (44) and multiple optional hanging holes (402). The two flanges (42) are formed respectively on the top and the bottom of the display panel (40). The multiple hooks (44) are formed on the two sides to engage the corresponding mounting slots (322). The hanging holes (402) are defined through the front and rear surfaces to attach hanging accessories (not shown). With further reference to FIG. 3, the hooks (44) on laterally adjacent display panels (40) mount respectively in the two internal recesses in a single mounting slot (322). With further reference to FIG. 7, one modular rack can be extended in width by adding bases (10), rod assemblies (20) and display panels (40) as desired.

Figure 4:
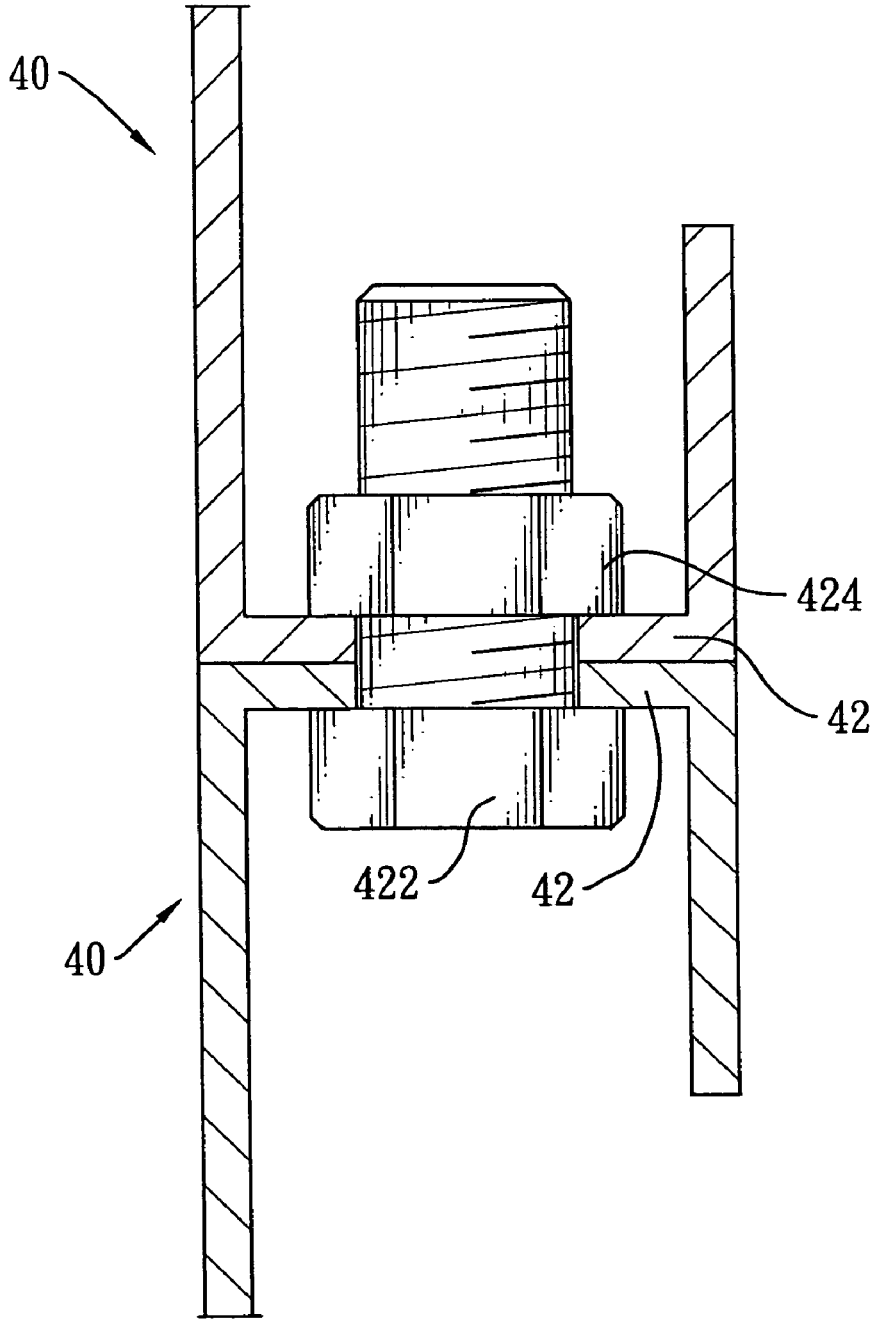
FIG. 4 is an enlarged side view in partial section of a joint between two display panels in FIG. 1.

With further reference to FIG. 4, the multiple securing elements strengthen the modular rack and individually comprise a nut (424) and a bolt.(422) The modular rack is strengthened by connecting vertically adjacent display panels (40) together with the securing elements. The flange (42) on the top of a display panel (40) abuts the flange (42) on the bottom of the display panel (40) above. The abutting flanges (42) are connected with bolts and nuts.

Figure 5:
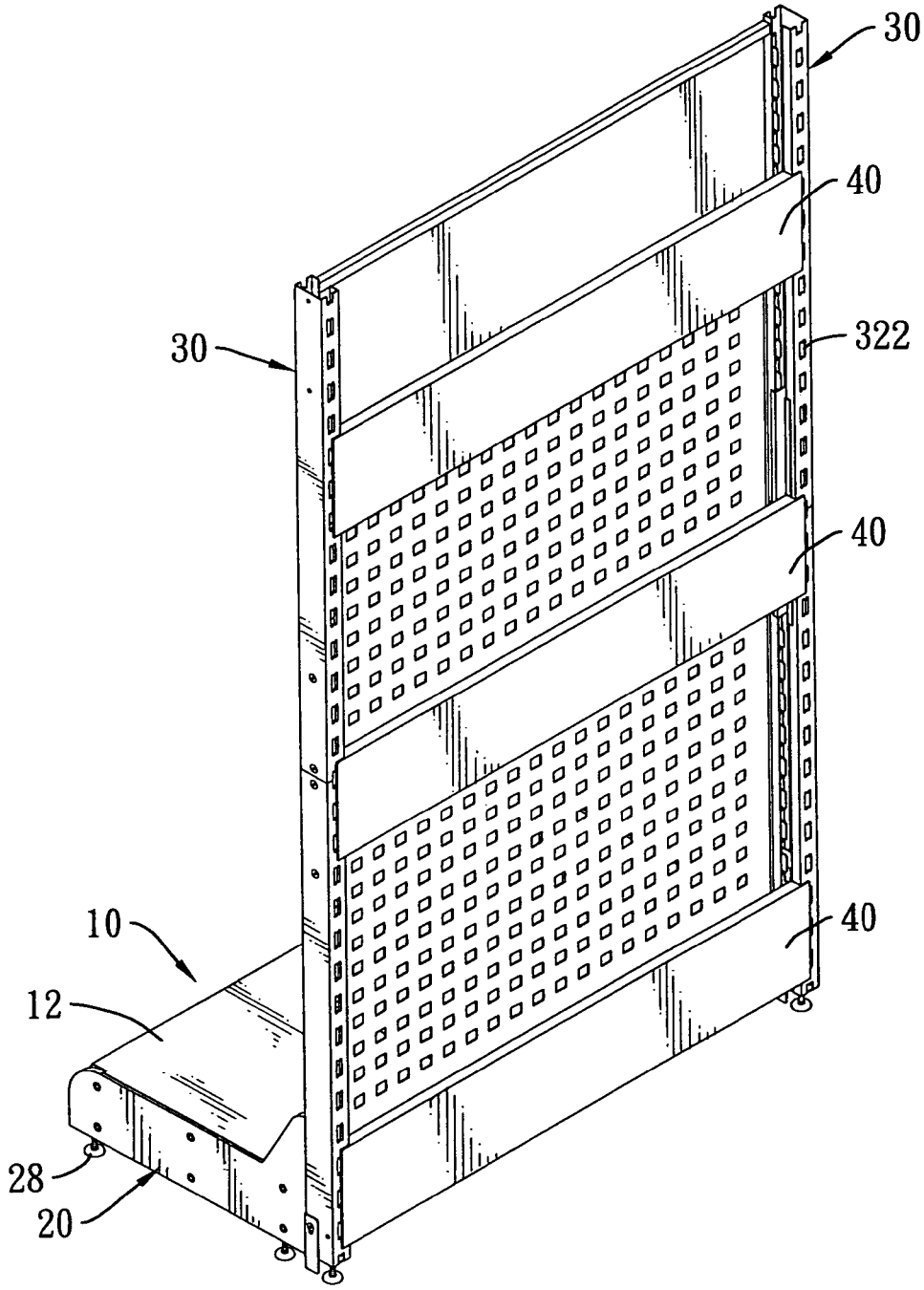
FIG. 5 is a perspective view of the rear of the modular rack in FIG. 1.

With further reference to FIG. 5, the tools and merchandise can be displayed on the front and the back behind because the mounting slots (322) are also defined in the rear face of the exterior rods (32). Therefore, display panels (40) can be mounted on the back of the modular rack. Furthermore, a display panel (40) without hanging holes (402) can be used to cover the nuts and bolts between adjacent panels (40) to keep the appearance of the modular rack neat even from the back.

Figure 8:
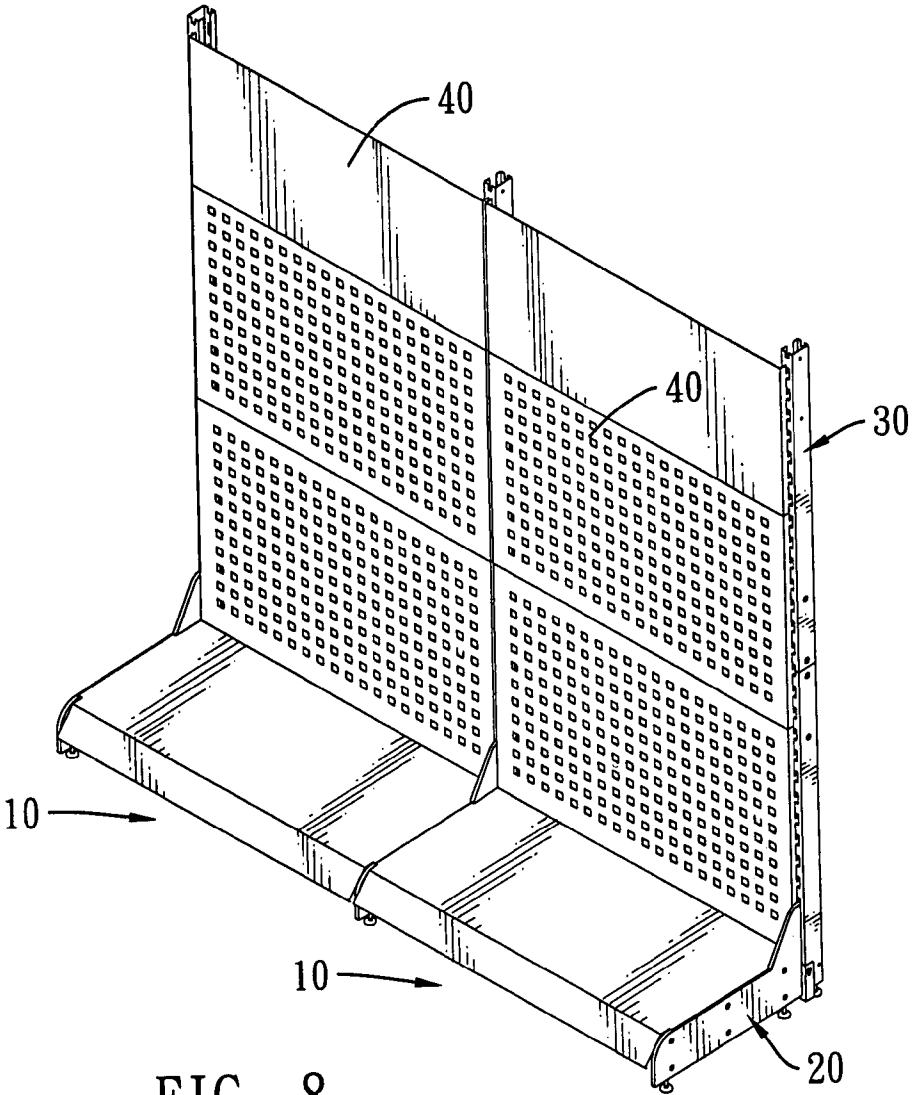
FIG. 8 is a perspective view of another embodiment of the modular rack extended in width in accordance with the present invention.
Figure 9:
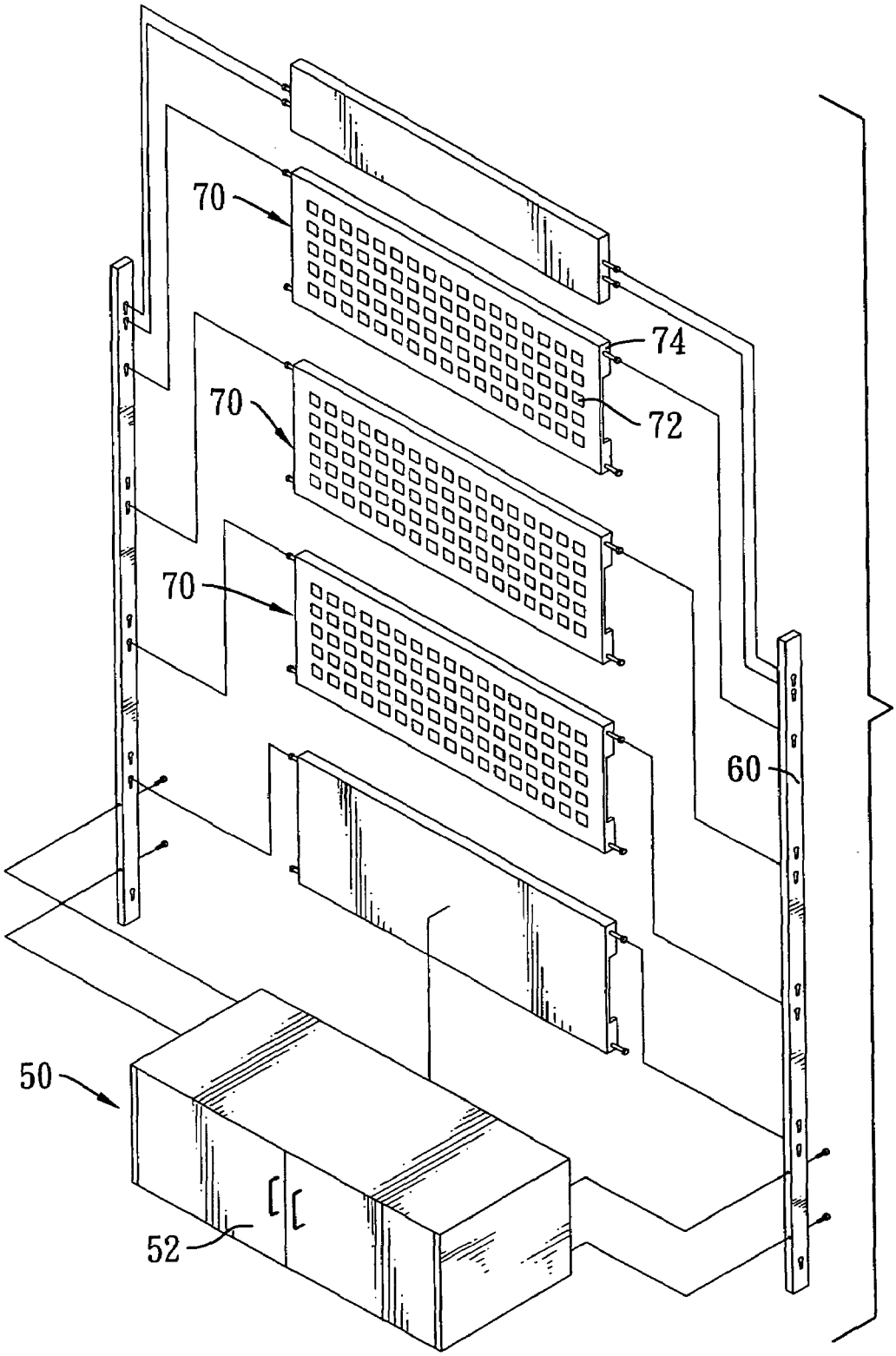
FIG. 9 PRIOR ART
FIG. 9 is an exploded perspective view of a conventional rack module in accordance with the prior art.

In FIG. 6, the modular rack is modified to have two bases (10) attached at two sides of the exterior rod (32) and multiple display panels are mounted on the front and rear faces of the exterior rods (32) respectively. Therefore, the tools and the merchandises can be displayed at the two sides of the modular rack. In FIGS. 7 and 8, the modular rack is particularly versatile in that it can be extended in height and width.

In conclusion, the modular rack for displaying tools and merchandise has the following advantages.

1. The rod assemblies in the modular rack can be extended in height by adding exterior rods and the corresponding connectors.

2. The mounting slots on the rod assemblies and the adjustable foot frame allow other panels and footplates on an adjacent modular rack to connect to so the modular rack can be extended in width.

3. Besides the extension in height and width, the modular rack can display tools and merchandise on the back so the appearance of the modular rack is versatile.

4. Because most assembly of elements in the modular rack is accomplished by simply inserting hooks into the corresponding mounting slots, assembly and disassembly of the modular rack are easy and convenient.

Although the invention has been explained in relation to its preferred embodiment, many other possible modifications and variations can be made without departing from the spirit and scope of the invention as hereinafter claimed.

What is claimed is:

1. A modular rack for displaying tools and merchandise, the modular rack comprising:

a base with two foot frames adjustable in width, each adjustable foot frame comprising:

two symmetrical panels respectively having multiple hooks; and multiple separators clamped between the two symmetrical panels; two rod assemblies attached detachably and respectively to the two foot frames and individually comprising at least two exterior rods individually having a front face;

a rear face; and multiple mounting slots defined in the front face and the rear face; and at least one interior connector connecting two adjacent exterior rods; and multiple display panels detachably and selectively attaching to the front faces and the rear faces of the two rod assemblies and individually having multiple hooks corresponding to and engaging the multiple mounting slots in the rod assemblies, wherein each display panel is rectangular and has a top, a bottom, two sides, a front surface, a rear surface, two flanges formed respectively on the top and the bottom of the panel;

said multiple hooks are formed on the two sides of said panels to engage the corresponding mounting slots on the rod assemblies; and each display panel further has hanging holes defined through the front and rear surfaces.

2. The modular rack as claimed in claim 1, wherein the base further comprises;

a footplate secured between the adjustable foot frames and individually having:

a front end;

a rear end;

two sides;

an inclined toe guard formed at the front end; and two connecting lips extending perpendicular downward respectively from the two sides of the footplate.

3. The modular rack as claimed in claim 2, wherein each adjustable foot frame further comprises:

said two symmetrical panels respectively defining as a first panel and a second panel and individually having a top edge;

a front end curved at the top edge;

an enlarged rear end diverging from the top edge;

a bottom edge;

an inside surface;

a rear edge;

said multiple hooks formed at the rear edge on each enlarged rear end; and a clamping flange formed on the top edge, extending toward the opposite symmetrical panel, having a width, clamping the connecting lips on the footplate, and holding the footplate in place;

the first symmetrical panel further having a first overlapping flange formed on the bottom edge, extending toward the second symmetrical panel and having a width at least two times larger than the width of the clamping flanges;

the first symmetrical panel further having multiple holes;

the second symmetrical panel further having a second overlapping flange formed on the bottom edge, extending toward the first symmetrical panel and having a width at least two times larger than the width of the clamping flanges;

the second symmetrical panel further having the multiple separators mounted on the inside surface and corresponding to the holes in the first panel, and each separator being cylindrical and has a threaded hole axially formed through the separator;

the first overlapping flange on the first symmetrical panel having multiple notches; and the second overlapping flange on the second symmetrical panel having multiple threaded rings formed on the top of the second overlapping flange and respectively extending through the notches in the first overlapping flange when the first and second overlapping flanges overlap each other;

multiple screws passing respectively through the holes in the first symmetrical panel and screwing respectively into the threaded holes in the separators on the second symmetrical panel to clamp the separators between the symmetrical panels and draw the clamping flanges together;

a bracket attached to the enlarged rear end of two symmetrical panels to engage a corresponding rod assembly;

multiple feet detachably attached to the overlapping flanges; and a dressing strip wedged between the two symmetrical panels at the curved angles.

4. The modular rack as claimed in claim 3, wherein the bracket is U-shaped and has:

a front;

a top;

two wings;

a slot defined in the in the front, extending to the top and holding the rear edge of the panels near the bottom and the overlapping flanges; and two holes defined respectively in the wings of the bracket near the top.

5. The modular rack as claimed in claim 1, wherein the exterior rods are U-shaped and individually further have an outer side, an open inner side and a longitudinal recess;

the mounting slots are defined through the front face and the rear face of the exterior rod at equal intervals, communicate with the longitudinal recess and have two internal recesses;

each interior connector is mounted inside the longitudinal recesses of adjacent exterior rods, is attached to the adjacent exterior rods to allow the rod assemblies to be extended in length, is U-shaped and has an inner edge that abuts the outer sides of the adjacent exterior rods and two sides; and the modular rack further has multiple screws penetrating through the inner edge of the interior connector and the outer sides of the two adjacent exterior rods.

* * * * *